US012297840B2

(12) United States Patent
Baba et al.

(10) Patent No.: US 12,297,840 B2
(45) Date of Patent: May 13, 2025

(54) BLOWER FAN

(71) Applicant: DENSO CORPORATION, Kariya (JP)

(72) Inventors: Tomomi Baba, Kariya (JP); Takuya Usami, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 18/514,403

(22) Filed: Nov. 20, 2023

(65) Prior Publication Data

US 2024/0084814 A1 Mar. 14, 2024

Related U.S. Application Data

(63) Continuation of application No. PCT/JP2022/022790, filed on Jun. 6, 2022.

(30) Foreign Application Priority Data

Jul. 2, 2021 (JP) ..... 2021-110939

(51) Int. Cl.
*F04D 29/38* (2006.01)
*F04D 29/32* (2006.01)

(52) U.S. Cl.
CPC ..... *F04D 29/325* (2013.01); *F04D 29/384* (2013.01)

(58) Field of Classification Search
CPC ..... F04D 29/384; F04D 29/325
See application file for complete search history.

(56) References Cited

U.S. PATENT DOCUMENTS 5,026,251 A * 6/1991 Kinoshita ..... F04D 29/666 415/206
5,273,400 A * 12/1993 Amr ..... F04D 29/386 416/189
6,558,123 B1 * 5/2003 Spaggiari ..... F04D 29/384 416/243
7,273,354 B2 * 9/2007 Spaggiari ..... F04D 29/384 416/223 R
2015/0152875 A1 6/2015 Kamiya et al.

FOREIGN PATENT DOCUMENTS

JP 5880288 B2 3/2016

* cited by examiner

*Primary Examiner* — Michael L Sehn
(74) *Attorney, Agent, or Firm* — Harness, Dickey & Pierce, P.L.C.

(57) ABSTRACT

A blower fan includes a hub, a plurality of blades and a ring. The blades are arranged along and extend outwardly from an outer periphery of the hub. The ring is shaped in a circular ring form and couples a distal end portion of each blade. The distal end portion of each blade has a separation limiting structure that limits separation of a flow of air from the blade. Each blade has a shape that directs a flow direction of the air passing through the blade to the separation limiting structure of an adjacent blade which is an adjacent one of the plurality of blades located on a rear side of the blade in a fan rotational direction.

11 Claims, 13 Drawing Sheets

BLOWER FAN

CROSS REFERENCE TO RELATED APPLICATIONS

This application is a continuation application of International Patent Application No. PCT/JP2022/022790 filed on Jun. 6, 2022, which designated the U.S. and claims the benefit of priority from Japanese Patent Application No. 2021-110939 filed on Jul. 2, 2021. The entire disclosures of all of the above applications are incorporated herein by reference.

TECHNICAL FIELD

The present disclosure relates to a blower fan.

BACKGROUND

Previously, there has been proposed a blower fan. This blower fan includes: a hub which is installed to a drive electric motor; a plurality of blades which are coupled to the hub; and a ring which couples a distal end portion of each of the blades. Serrations, which are formed as a plurality of projections respectively shaped in a triangular form, are formed along a blade leading edge from a center portion to the distal end portion of each blade. By forming the serrations at the blade leading edge of the blade, a flow of the air is less likely to be separated from a negative pressure surface of the blade at the time of rotating the blower fan. Thus, generation of noise is limited.

SUMMARY

This section provides a general summary of the disclosure, and is not a comprehensive disclosure of its full scope or all of its features.

According to the present disclosure, there is provided a blower fan that includes a hub, a plurality of blades and a ring. The plurality of blades are arranged along and extend outwardly from an outer periphery of the hub. The ring is shaped in a circular ring form and couples a distal end portion of each of the plurality of blades. The distal end portion of each of the plurality of blades has a separation limiting structure that is configured to limit separation of a flow of air from the blade. Each blade among the plurality of blades has a shape that directs a flow direction of the air passing through each blade to the separation limiting structure of an adjacent blade which is an adjacent one of the plurality of blades located on a rear side of each blade in the fan rotational direction.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
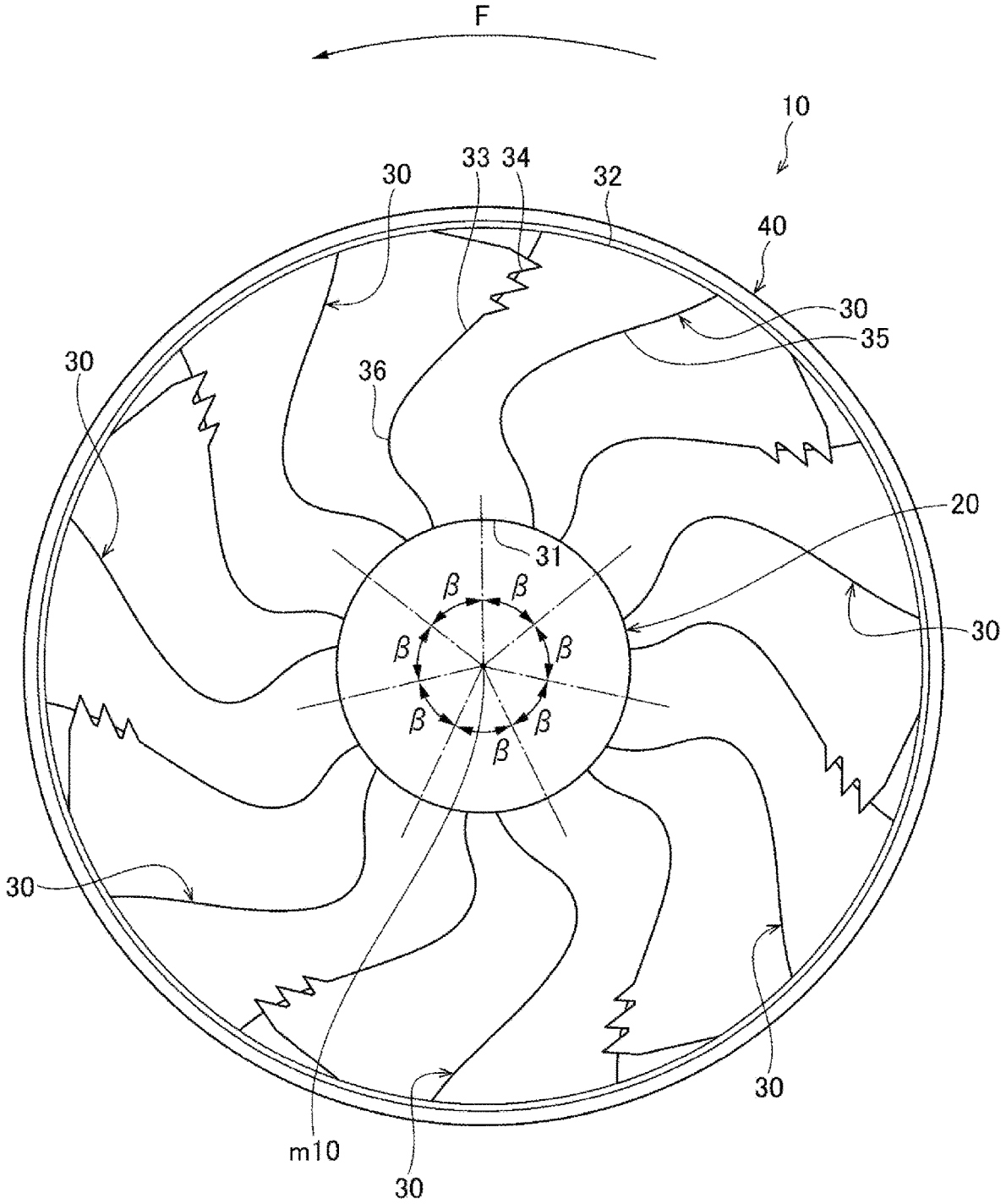
FIG. 1 is a front view of a structure of a blower fan according to a first embodiment.

Previously, there has been proposed a blower fan. This blower fan includes: a hub which is installed to a drive electric motor; a plurality of blades which are coupled to the hub; and a ring which couples a distal end portion of each of the blades. Serrations, which are formed as a plurality of projections respectively shaped in a triangular form, are formed along a blade leading edge from a center portion to the distal end portion of each blade. By forming the serrations at the blade leading edge of the blade, a flow of the air is less likely to be separated from a negative pressure surface of the blade at the time of rotating the blower fan. Thus, generation of noise is limited.

In the case of the blower fan described above, although the serrations are formed from the center portion to the distal end portion of each blade, the serrations are not formed at a base end portion of the blade. Therefore, the flow of the air is likely to be separated from the blade at the negative pressure surface of the base end portion of the blade. This results in generation of the noise at the time of rotating the blower fan.

According to one aspect of the present disclosure, there is provided a blower fan configured to be rotated about a fan rotational axis, which is predetermined, in a fan rotational direction. The blower fan includes: a hub that is placed on the fan rotational axis; a plurality of blades that are arranged along and extend outwardly from an outer periphery of the hub; and a ring that is shaped in a circular ring form and couples a distal end portion of each of the plurality of blades. The distal end portion of each of the plurality of blades has a separation limiting structure that is configured to limit separation of a flow of air from the blade. Each blade among the plurality of blades has a shape that directs a flow direction of the air passing through each blade to the separation limiting structure of an adjacent blade which is an adjacent one of the plurality of blades located on a rear side of each blade in a fan rotational direction.

With this configuration, the air, which has passed through a predetermined one of the plurality of blades, can flow more easily toward the separation limiting structure of the adjacent blade located on the rear side of the predetermined one of the plurality of blades, so that the effectiveness of the serrations can be increased. Thus, the generation of the noise can be more appropriately limited while maintaining the appropriate flow rate of the air.

Hereinafter, embodiments of a blower fan will be described with reference to the drawings. In order to facilitate understanding of the description, the same components are indicated by the same reference signs as much as possible in each drawing, and redundant descriptions are omitted.

First Embodiment

First, a blower fan 10 of a first embodiment shown in FIG. 1 will be described. The blower fan 10 is rotated about a fan rotation axis m10 in a direction indicated by an arrow F to generate a flow of the air in a direction along the fan rotation axis m10. The blower fan 10 is made of resin or another material. The blower fan 10 includes a hub 20, a plurality of blades 30 and a ring 40. Hereinafter, the direction, which is indicated by the arrow F, will be referred to as a fan rotational direction F, and a radial direction of the fan rotational axis m10 will be referred to as a fan radial direction.

The hub 20 is placed on the fan rotational axis M10 and is shaped in a bottomed cylindrical tubular form that is centered on the fan rotational axis M10.

The blower fan 10 includes the plurality of blades 30 (specifically, seven blades 30). The blades 30 are arranged along and extend outwardly from an outer periphery of the hub 20 in the fan radial direction. Each of the blades 30 has a curved form that is curved to project in the fan rotational direction F. Hereinafter, an end portion of each blade 30, which is joined to the hub 20, will be referred to as a base end portion 31, and an opposite end portion of the blade 30, which is opposite to the base end portion 31, will be referred to as a distal end portion 32. The blades 30 respectively have an identical shape and are arranged at equal angular intervals 13 in the fan rotational direction F. That is, the blades 30 are arranged at equal pitches.

The ring 40 is shaped in a circular ring form centered on the fan rotational axis m10 and is arranged to couple the distal end portion 32 of each blade 30.

In this blower fan 10, when a drive force of an electric motor (not shown) is transmitted to the hub 20, the hub 20 is rotated about the fan rotational axis m10 in the fan rotational direction F. Therefore, the blades 30 and the ring 40 are rotated integrally with the hub 20 in the fan rotational direction F.

Next, a shape of the respective blades 30 of the present embodiment will be specifically described.

As shown in FIG. 1, each of the blades 30 has a bent portion 36 at a location that is on a base side, at which the base end portion 31 is placed, of a center that is centered between the base end portion 31 and the distal end portion 32. The bent portion 36 projects in the fan rotational direction F. Therefore, the blade 30 is shaped in an L-shape as a whole.

A plurality of serrations 34 are formed at a leading edge 33 of the distal end portion 32 of the blade 30, while the leading edge 33 is located on a front side in the fan rotational direction F. The serrations 34 are formed as a plurality of projections respectively shaped in a triangular form. The serrations 34 function as a separation limiting structure that limits separation of a flow of the air from the blade 30. Since the serrations 34 limit the separation of the flow of the air from the blade 30, generation of a noise can be limited at the time of rotating the blower fan.

Figure 2:
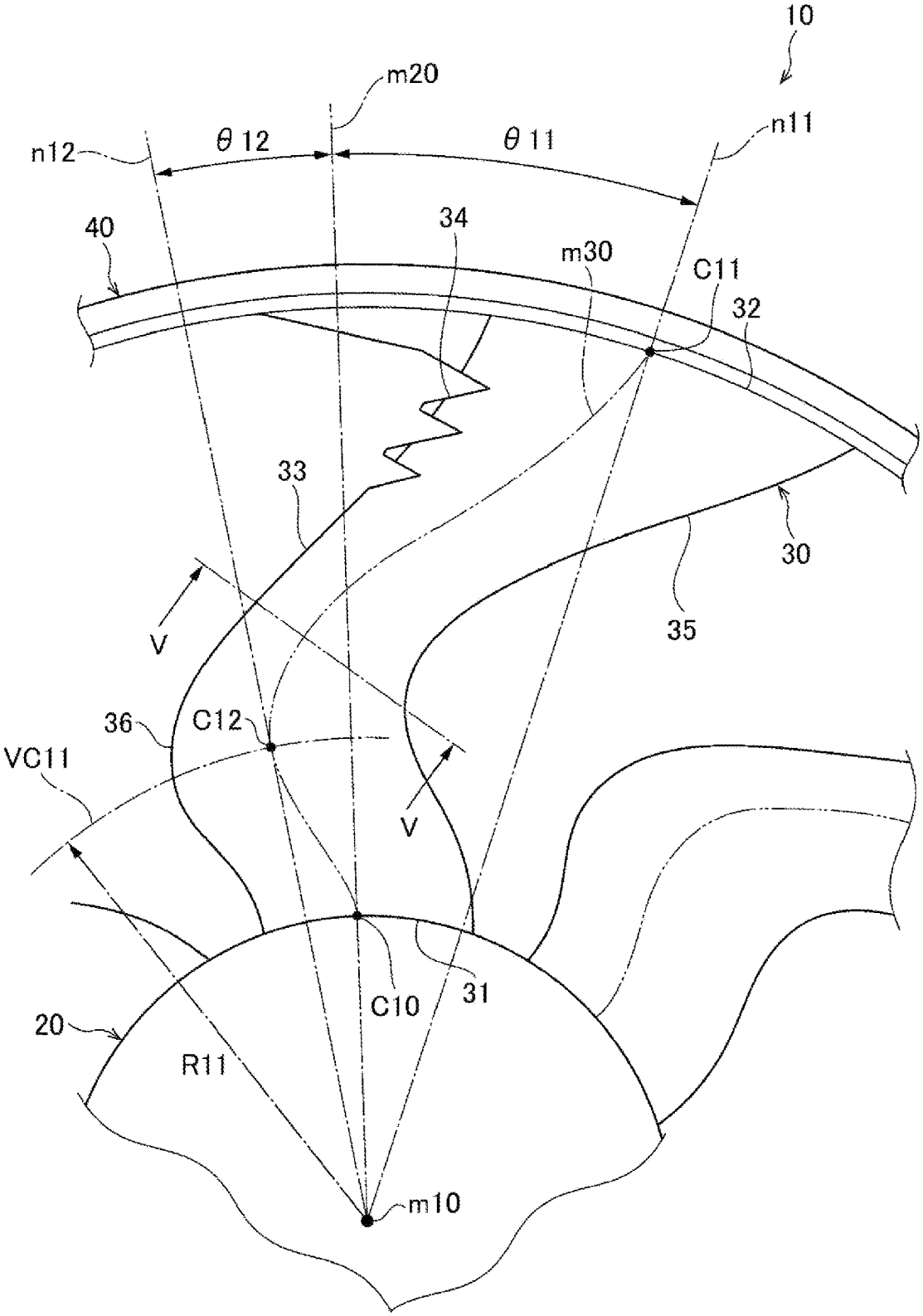
FIG. 2 is an enlarged view showing a structure of a blade according to the first embodiment.

As shown in FIG. 2, a center point at each of certain locations of the blade 30, which are arranged in a fan radial direction of the blade 30, can be defined as, for example, C10, C11, and C12. Here, the point C10 is a center point of a width of the base end portion 31 of the blade 30 centered in a fan circumferential direction. The point C11 is a center point of a width of the distal end portion 32 of the blade 30 centered in the fan circumferential direction at a radial location where the serrations 34 are not formed. Furthermore, the point C12 is a center point of a width of a portion of the blade 30 located on an imaginary circle VC11 which is centered on the fan rotational axis m10 and has a radius R11.

By using these center points C10-C12, a reference line m20 of the blade 30 is defined as indicated by a dot-dash line in FIG. 2, and a blade centerline m30 of the blade 30 is defined as indicated by a dot-dot-dash line in FIG. 2. That is, the reference line m20 is a straight line that intersects the fan rotational axis m10 at a right angle and passes through the center point C10 of the base end portion 31 of the blade 30. The blade centerline m30 is a line that extends from the base end portion 31 to the distal end portion 32 along the center points C10-C12 of the blade 30.

Furthermore, an angle of a line (straight line), such as a line n11 or a line n12 of FIG. 2, which is perpendicular to the fan rotational axis m10 and passes through a corresponding predetermined location along the blade centerline m30 of the blade 30, relative to the reference line m20, is defined as a skew angle θ at the corresponding predetermined location of the blade 30. The line n11 is a straight line that is perpendicular to the fan rotational axis m10 and passes through the point C11. The skew angle at the point C11 of the blade centerline m30 of the blade 30 is defined by an angle θ11 of this line n11 relative to the reference line m20. Furthermore, the line n12 is a straight line that is perpendicular to the fan rotational axis m10 and passes through the point C12. The skew angle at the point C12 of the blade centerline m30 of the blade 30 is defined by an angle θ12 of this line n12 relative to the reference line m20. In the present embodiment, each of the lines n11, n12 serves as a predetermined location line.

With respect to the skew angle θ of the present embodiment, the reference line m20 serves as a reference, i.e., is defined to be located at 0°, and an angle, which is displaced from the reference line m20 in the fan rotational direction F is expressed by a positive value, and an angle, which is displaced from the reference line m20 in an opposite direction that is opposite to the fan rotational direction F, is expressed by a negative value. Therefore, the skew angle θ11 at the point C11 of the blade 30 is a negative value, and the skew angle θ12 at the point C12 of the blade 30 is a positive value.

Figure 3:
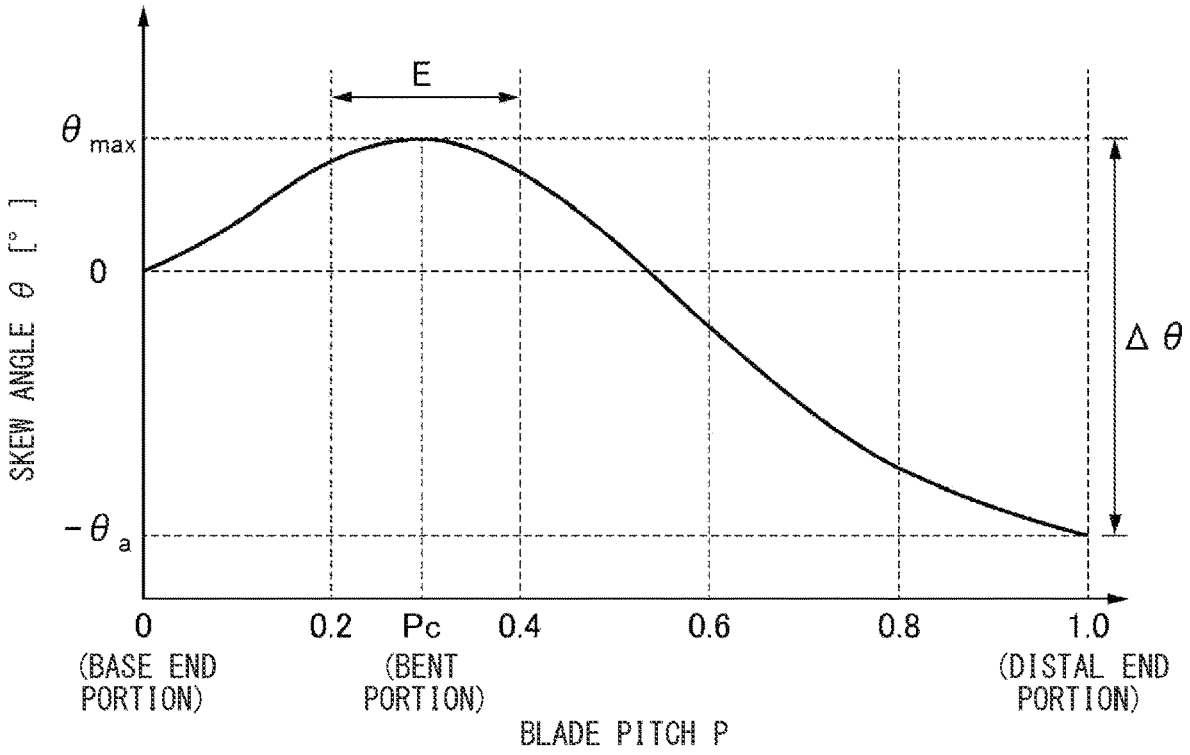
FIG. 3 is a graph showing a relationship between a blade pitch and a skew angle of the blade according to the first embodiment.

The skew angle θ of each blade 30 changes from the base end portion 31 to the distal end portion 32 as shown in FIG. 3. The blade pitch P in FIG. 3 is defined as a parameter that is obtained by normalizing a radial location along the blade centerline m30 of the blade 30 with a value in a range of 0 to 1.0, where 0 corresponds to a location (radial location) of the base end portion 31, and 1 corresponds to a location (radial location) of the distal end portion 32. Therefore, the location along the blade centerline m30 of the blade 30, which corresponds to the blade pitch P of 0.5, is a center of the blade centerline m30. Furthermore, the blade pitch P, which corresponds to the location of the bent portion 36 of the blade 30, is indicated by Pc in FIG. 3.

As shown in FIG. 3, in a range of the blade pitch P from 0 to Pc, when the blade pitch P is increased, the skew angle θ of the blade 30 is progressively increased. Then, at the bent portion 36 of the blade 30, at which the blade pitch P is Pc, the skew angle θ of the blade 30 reaches a maximum value θmax. Furthermore, in a range of the blade pitch P from Pc to 1.0, when the blade pitch P is increased, the skew angle θ of the blade 30 is progressively reduced. At the distal end portion 32 of the blade 30, at which the blade pitch P is 1.0, the skew angle θ of the blade 30 is a negative value −θa. Each blade 30 has a shape where the skew angle θ changes with respect to the blade pitch P in a manner shown in FIG. 3.

The amount of change Δθ of the skew angle θ in the range of the blade pitch P from Pc to 1.0, i.e., the amount of change of the skew angle θ in a range from the bent portion 36 to the distal end portion 32 of the blade 30 is set in a range of 25° to 40°. Furthermore, the bent portion 36 is located in a range E of the blade 30, which corresponds to the blade pitch P of 0.2 to 0.4.

Figure 4:
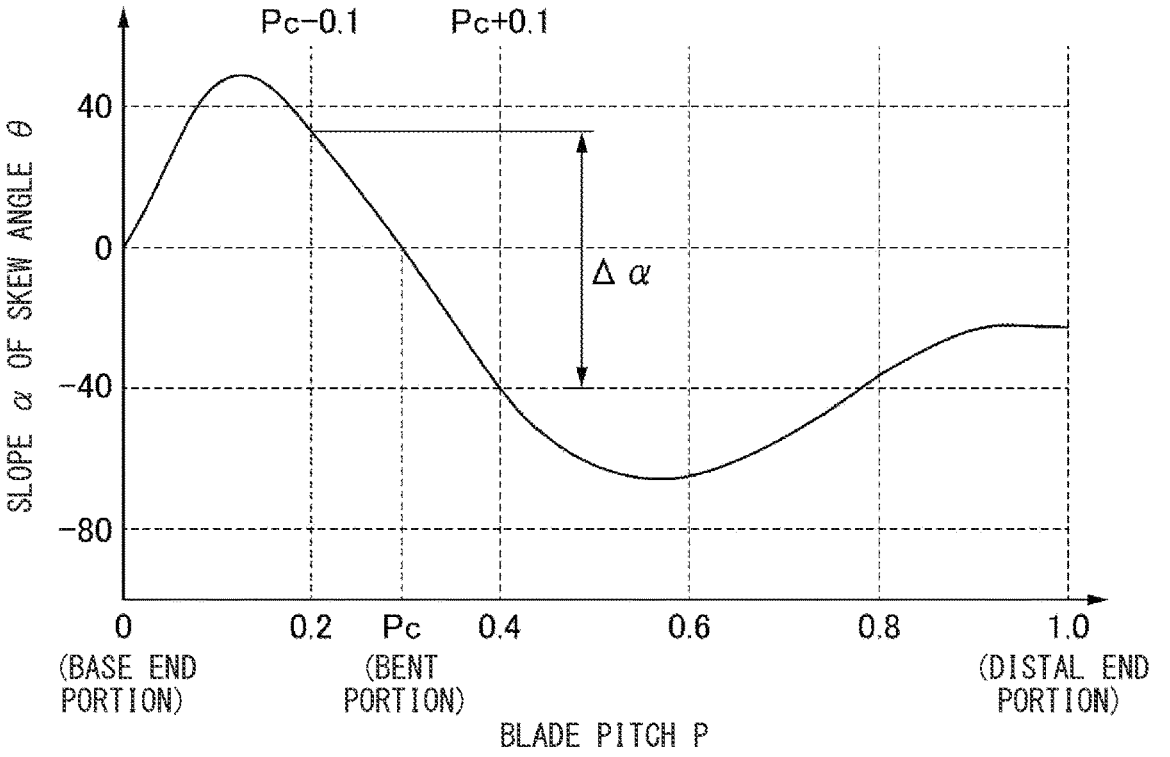
FIG. 4 is a graph showing a relationship between the blade pitch and a slope of the skew angle of the blade according to the first embodiment.

FIG. 4 indicates a relationship between a slope a of the skew angle θ shown in FIG. 3 and the blade pitch P. As shown in FIG. 4, the amount of change in the slope of the skew angle θ in a range of the blade 30, which corresponds to the blade pitch of Pc−0.1 to Pc+0.1, is set to be in a range of 60° to 90°.

Figure 5:
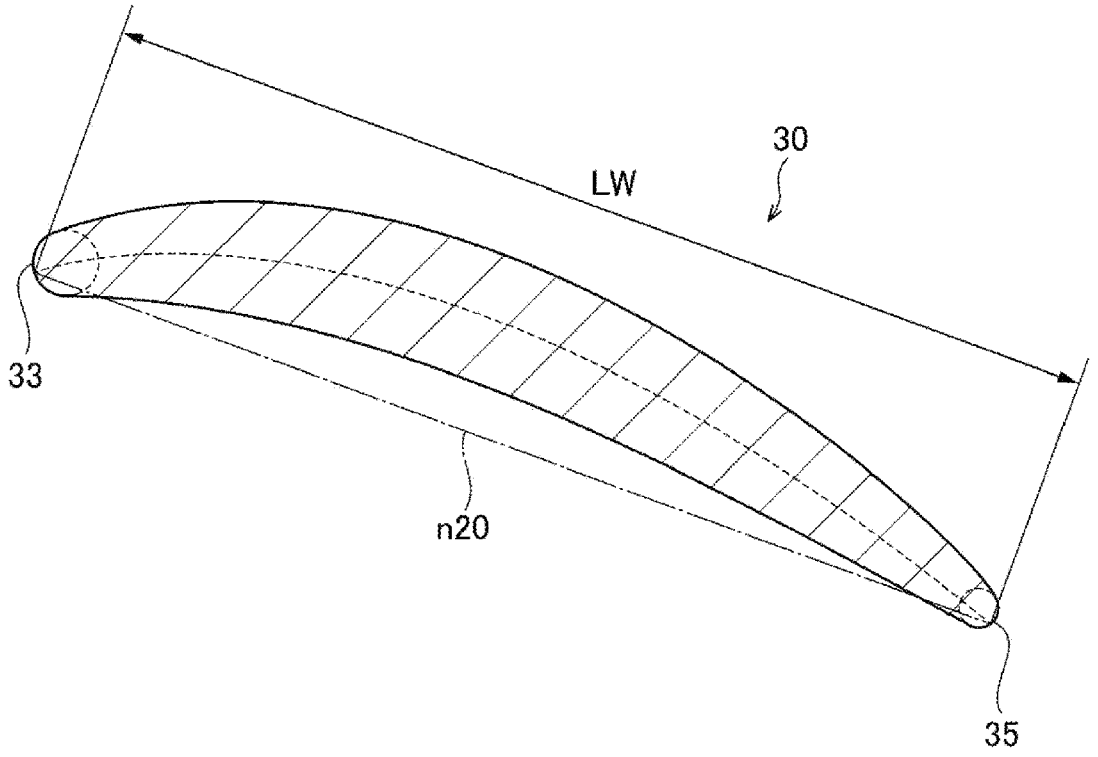
FIG. 5 is a cross-sectional view taken along line V-V in FIG. 2.
Figure 6:
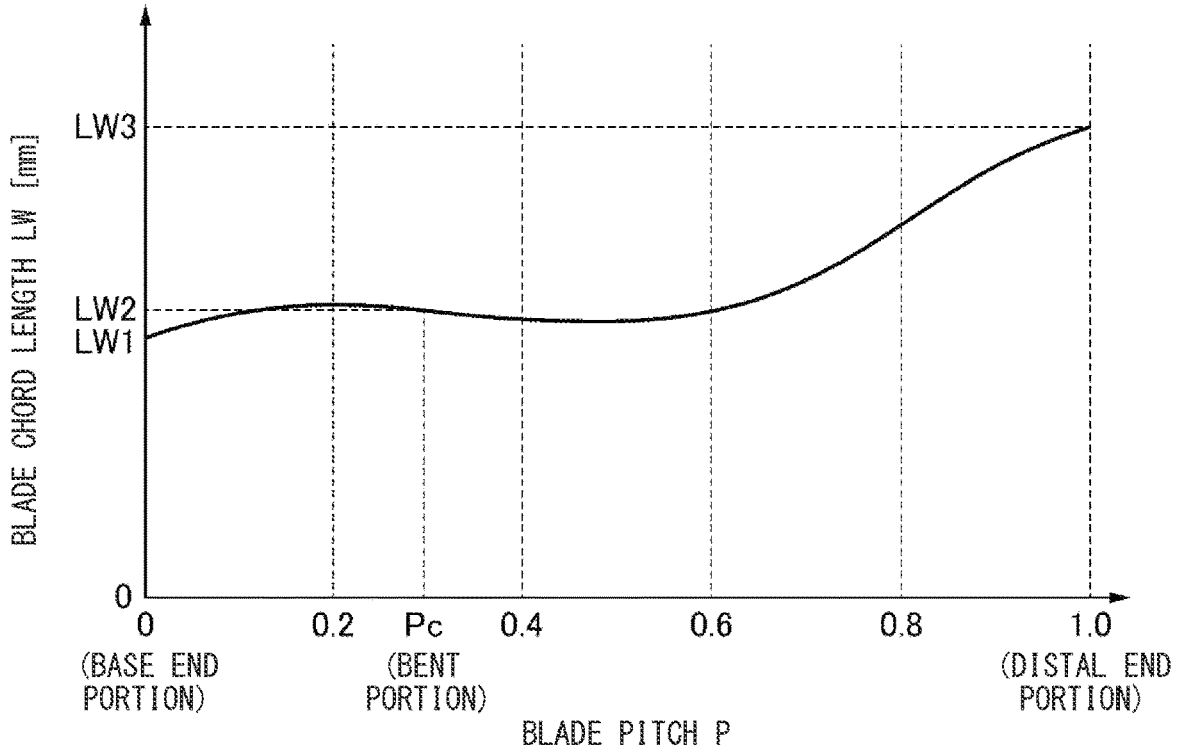
FIG. 6 is a graph showing a relationship between the blade pitch and a chord length of the blade according to the first embodiment.

FIG. 5 shows a structure of a cross-section of the blade 30 which is taken along line V-V in FIG. 2. As shown in FIG. 5, a length of a straight line n20, which connects between a leading edge 33 and a trailing edge 35 of the blade 30 along the cross-section of the blade 30, is defined as a chord length LW. The chord length LW is set relative to the blade pitch P in a way shown in FIG. 6. As shown in FIG. 6, a chord length LW2 of the bent portion 36 of the blade 30 is longer than a chord length LW1 of the base end portion 31 of the blade 30, and a chord length LW3 of the distal end portion 32 of the blade 30 is longer than the chord length LW2 of the bent portion 36 of the blade 30.

Figure 7:
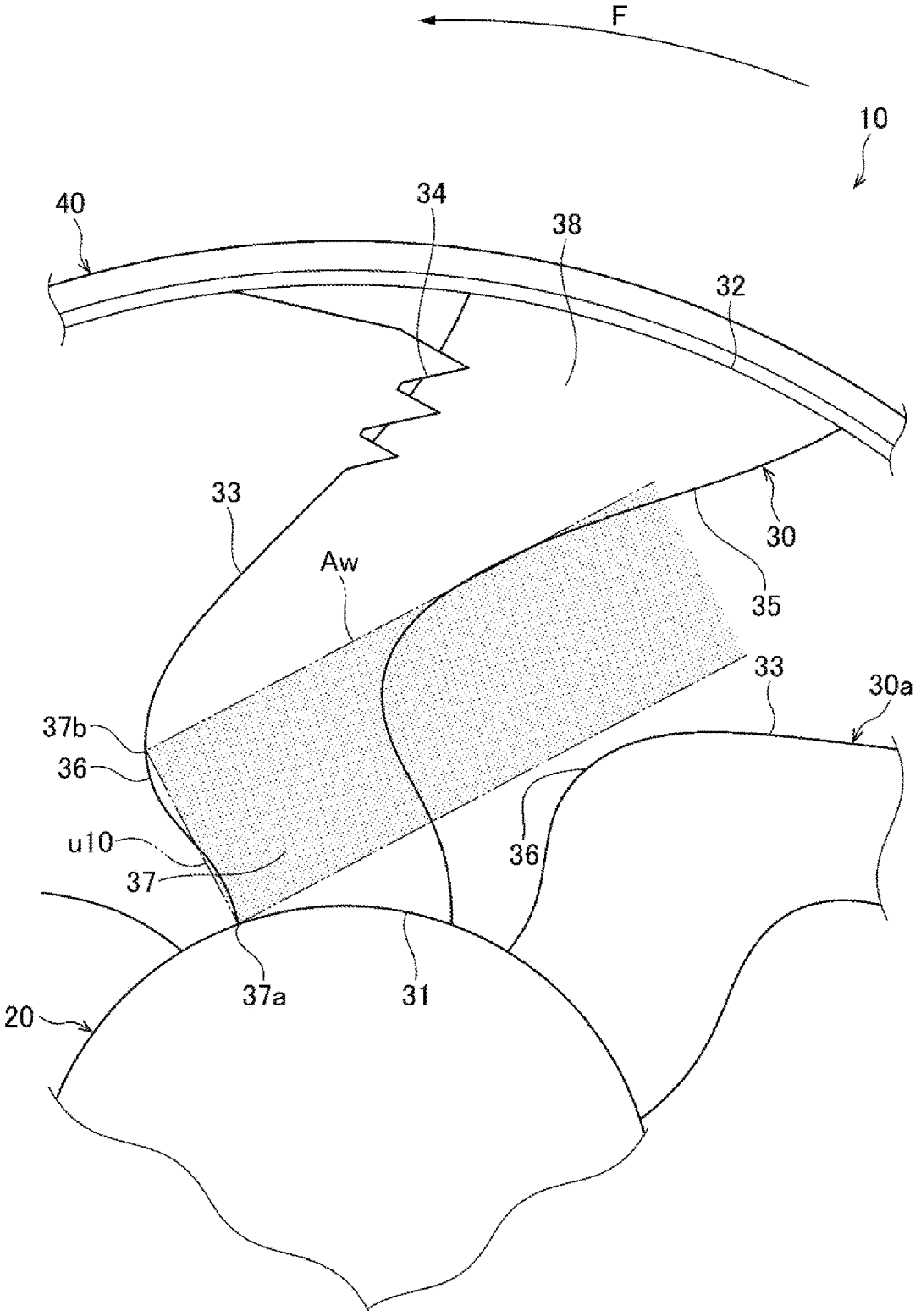
FIG. 7 is an enlarged view showing a structure of the blade according to the first embodiment.
Figure 8:
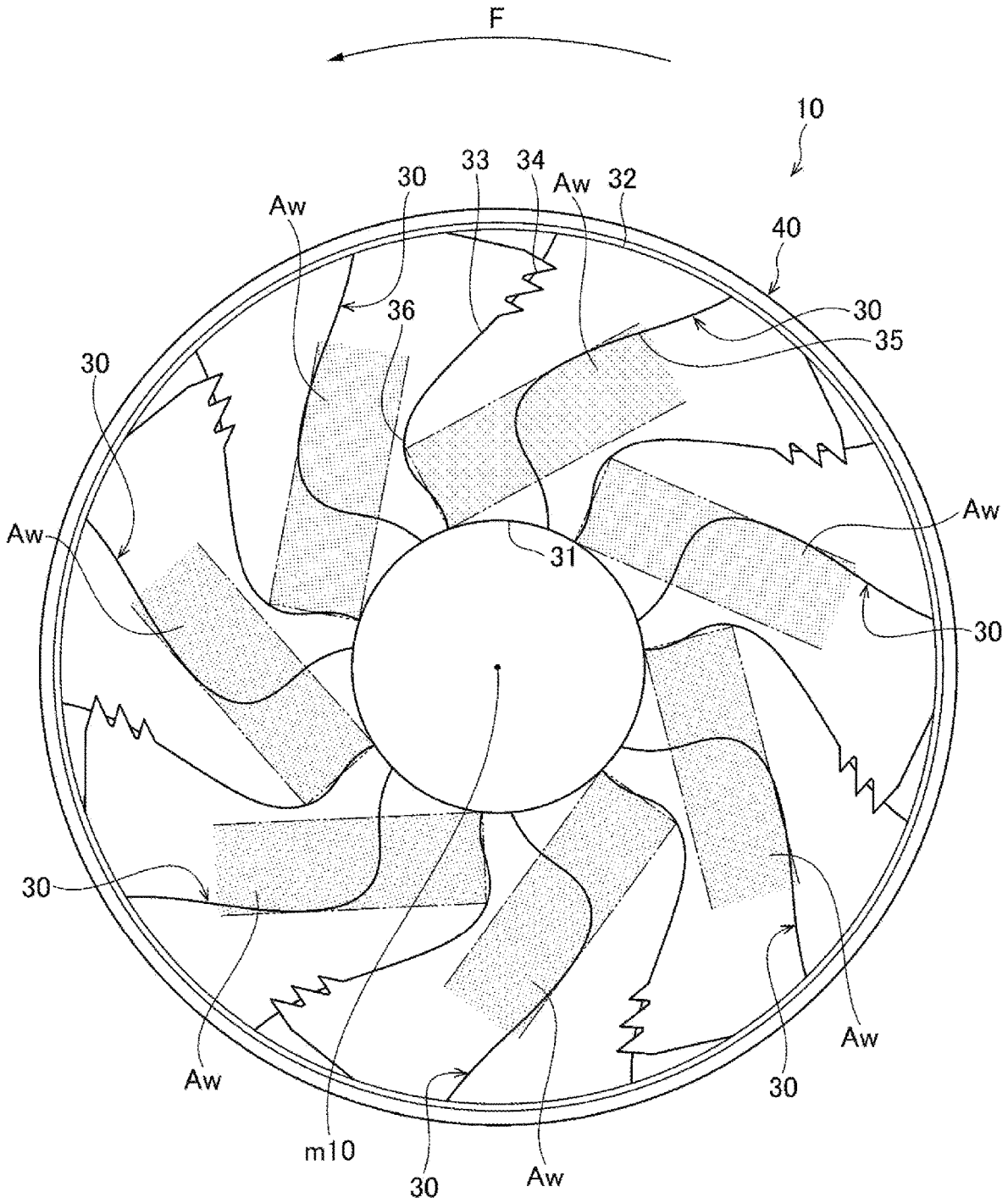
FIG. 8 is a front view showing the structure of the blower fan of the first embodiment.

In FIG. 7, at the blade 30, an inner portion, which is defined as a portion of the blade 30 that extends from the base end portion 31 to the bent portion 36, is indicated by a reference sign 37. Furthermore, an outer portion, which is defined as a portion of the blade 30 that extends from the bent portion 36 to the distal end portion 32, is indicated by a reference sign 38. Furthermore, in FIG. 7, a straight connecting line, which connects between one end 37*a* of the leading edge 33 of the inner portion 37 located at the base end portion 31 and the other end 37*b* of the leading edge 33 of the inner portion 37 located at the bent portion 36, is indicated by a dot-dot-dash line u10. In the following description, a rear-side airflow region Aw is defined as a region that is formed by projecting this dot-dot-dash line u10 in a direction that is perpendicular to the dot-dot-dash line u10 toward the rear side in the fan rotational direction F. Furthermore, an adjacent one of the blades 30, which is located on the rear side of any one of the blades 30 in the fan rotational direction F, is defined as an adjacent blade 30*a*. By forming each blade 30 in the way shown in FIGS. 4 to 6, each blade 30 has a shape, with which the rear-side airflow region Aw does not overlap with an entire range of the leading edge 33 of the adjacent blade, as shown in FIG. 8.

Next, actions and advantages of the blower fan 10 of the present embodiment will be described.

Figure 9:
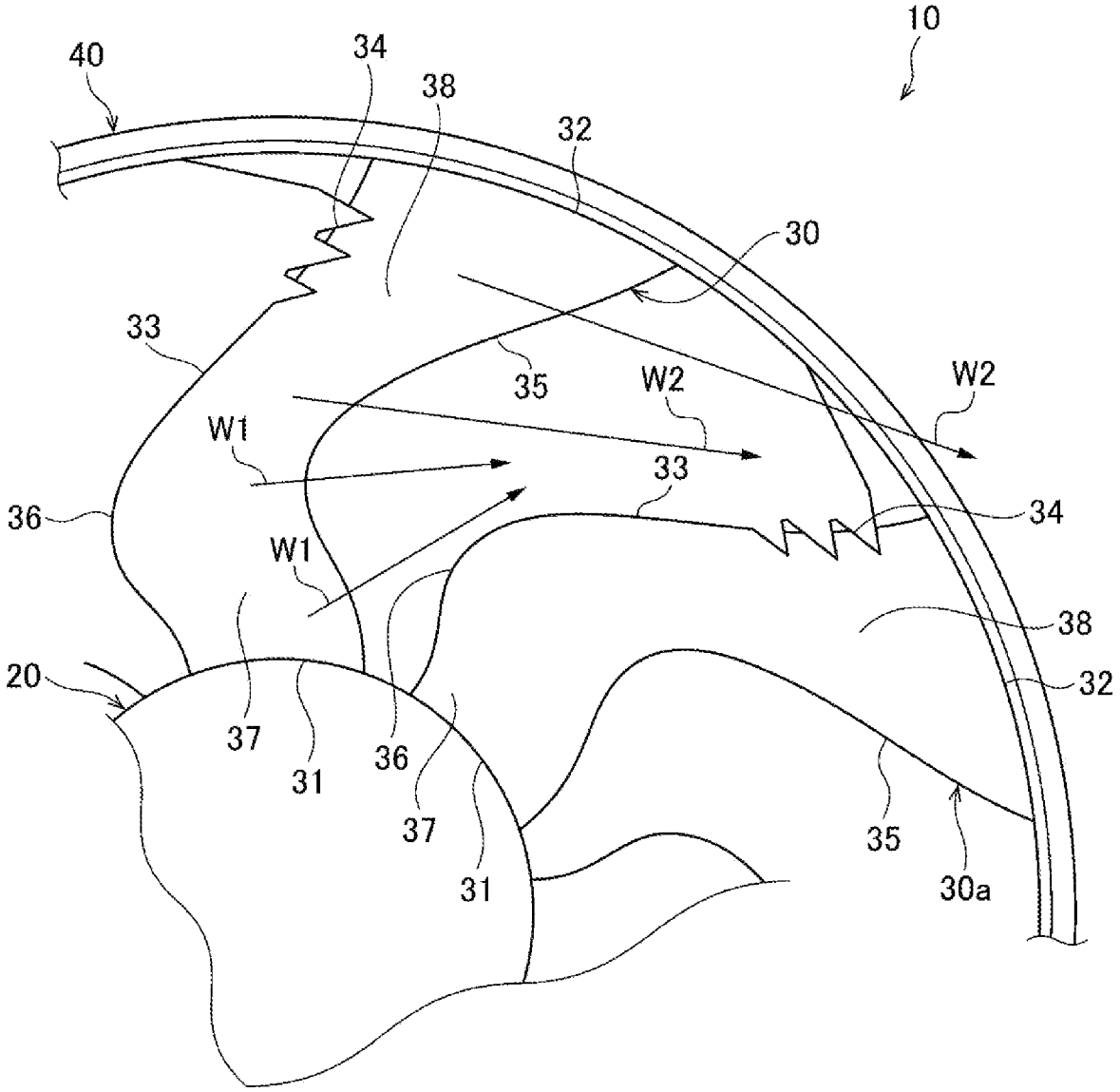
FIG. 9 is a diagram schematically showing a flow of the air at the blade according to the first embodiment.

At the blower fan 10 of the present embodiment, when the blower fan 10 is rotated, a flow of the air indicated with arrows in FIG. 9 is generated. Specifically, a flow direction W1 of the air, which has passed through the inner portion 37 of the blade 30, is obliquely directed toward the ring 40. Furthermore, a flow direction W2 of the air, which has passed through the outer portion 38 of the blade 30, becomes a direction that is directed toward the outer portion 38 of the adjacent blade 30*a*. Therefore, the air, which has passed through each blade 30, is concentrated around the serrations 34 of the adjacent blade 30*a* located on the rear side of each blade 30, so that the noise reducing effect of the serrations 34 for reducing the noise can be effectively obtained. As a result, it is possible to obtain the noise reducing effect that is equal to or greater than a sum of the noise reducing effect of the serrations alone and the noise reducing effect of the blade alone.

According to the blower fan 10 of the present embodiment described above, the following actions and advantages indicated at the following sections (1) to (4) can be obtained.

(1) Each blade 30 has the shape that directs the flow direction of the air, which passes through each blade 30, toward the serrations 34 of the adjacent blade 30*a* located on the rear side of each blade 30. With this configuration, the air, which has passed through each blade 30, can flow more easily toward the serrations 34 of the adjacent blade 30*a*, so that the effectiveness of the serrations 34 can be increased. Thus, the generation of the noise can be more appropriately limited while maintaining the appropriate flow rate of the air.

(2) As shown in FIG. 3, each blade 30 has the shape, with which the skew angle θ is progressively increased from the base end portion 31 to the bent portion 36 and reaches the maximum value at the bent portion 36, and the skew angle θ is progressively reduced from the bent portion 36 to the distal end portion 32 and becomes the negative value at the distal end portion 32. This configuration makes it easy to achieve the shape of the blade 30 that directs the flow direction of the air, which passes through the blade 30, toward the serrations 34 of the adjacent blade 30*a*.

(3) As shown in FIG. 7, each blade 30 has the shape, with which the rear-side airflow region Aw of the inner portion 37 of each blade 30 does not overlap with the entire range of the leading edge 33 of the adjacent blade 30*a*. With this configuration, the air, which has passed through the inner portion 37 of each blade 30, can be more easily concentrated around the serrations 34 of the adjacent blade 30*a*, so that the effectiveness of the serrations 34 can be further increased.

Figure 10:
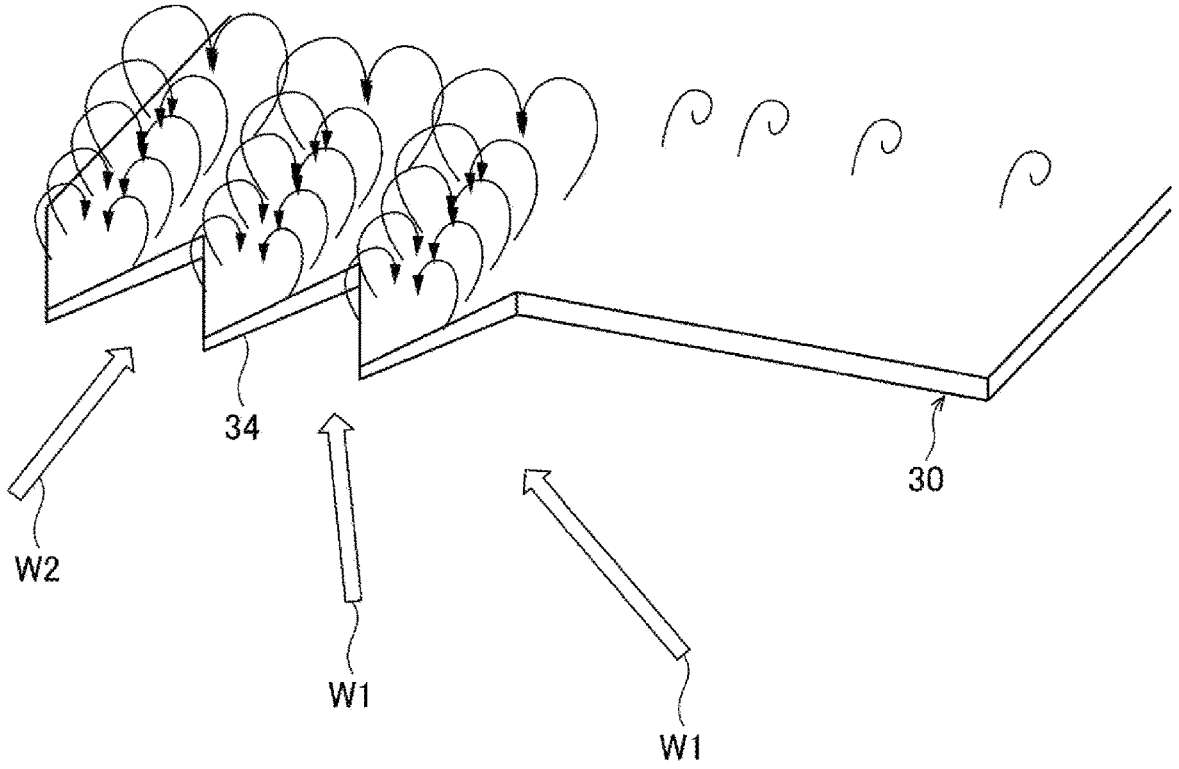
FIG. 10 is a diagram schematically showing a flow of the air around serrations of the blade according to the first embodiment.

(4) At each blade 30, the separation limiting structure, which limits the separation of the flow of the air from each blade 30, includes the serrations 34 that are formed as the plurality of projections respectively shaped in the triangular form. With this configuration, as indicated by arrows in FIG. 10, the air, which is concentrated around the serrations 34 of the blade 30, forms a flow of the air that holds down the air, which is separating from a negative pressure surface of blade 30, and thereby the separation of the flow of the air from the negative pressure surface of the blade 30 can be more appropriately limited. Therefore, the noise reducing effect for reducing the noise can be improved.

Second Embodiment

Next, a blower fan 10 according to a second embodiment will be described. The following description focuses on differences relative to the blower fan 10 of the first embodiment.

Figure 11:
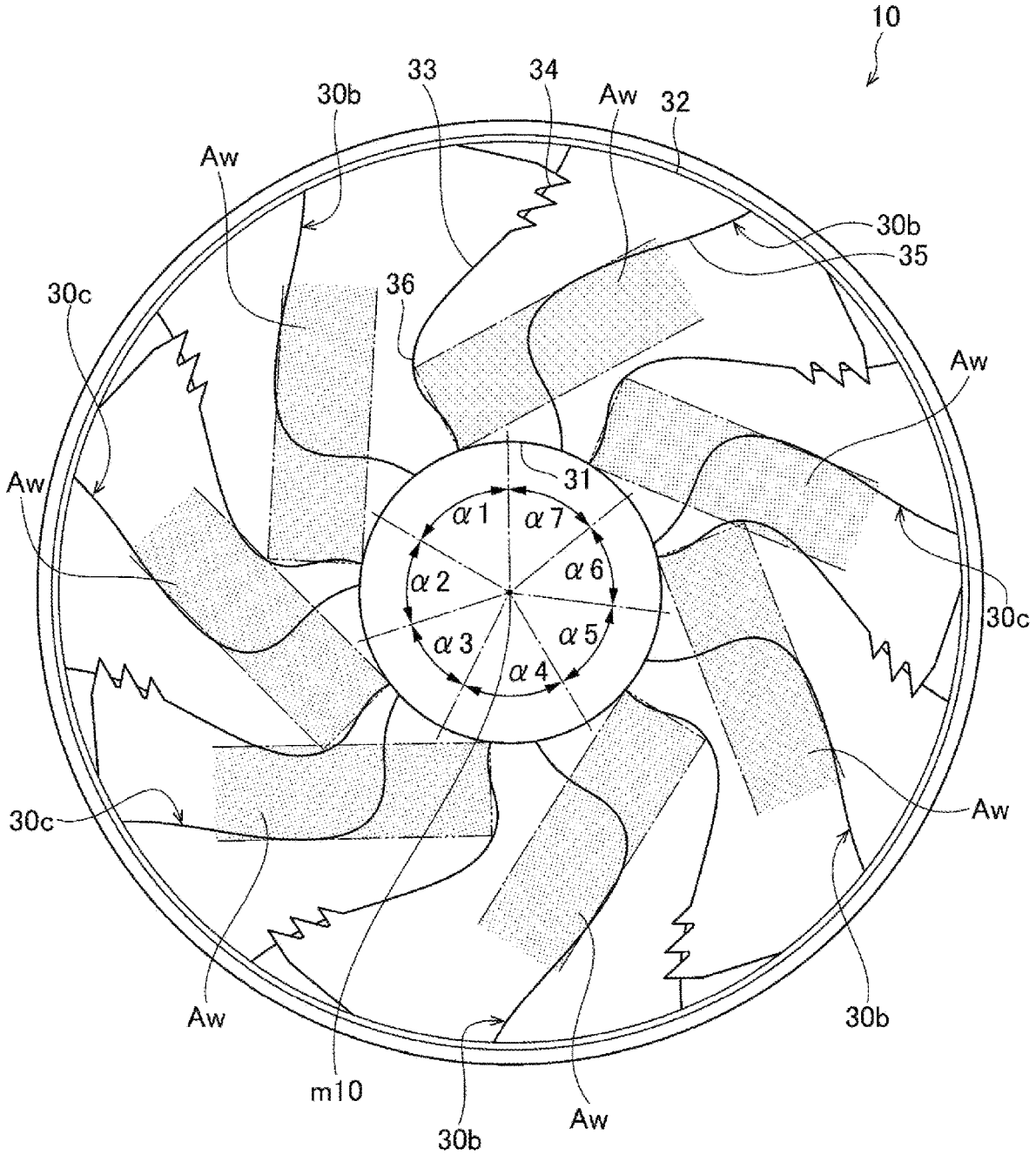
FIG. 11 is a front view of a structure of a blower fan according to a second embodiment.

As shown in FIG. 11, in the blower fan 10 of the present embodiment, when the angular intervals of the blades 30 are respectively indicated by $\alpha 1$ to $\alpha 7$, all of the angular intervals $\alpha 1$ to $\alpha 7$ are set to different values, respectively. That is, the blades 30 are arranged at unequal pitches, respectively.

The blower fan 10 includes: one or more primary blades (more specifically, a plurality of primary blades) 30*b*, at each of which the rear-side airflow region Aw of the inner portion 37 does not overlap with the entire range of the leading edge 33 of the adjacent blade; and one or more secondary blades 30 (more specifically, a plurality of secondary blades) 30*c*, at each of which the rear-side airflow region Aw of the inner portion 37 overlaps with the leading edge 33 of the adjacent blade. In the blower fan 10 of the present embodiment, the number of the primary blades 30*b* is four, and the number of the secondary blades 30*c* is three. Therefore, the number of the primary blades 30*b* is larger than the number of the secondary blades 30*c*.

According to the blower fan 10 of the present embodiment, the following action and advantage recited at the following section (5) can be achieved in addition to the actions and advantages recited at the above sections (1) to (4).

(5) The plurality of blades 30 are arranged at different angular intervals, respectively, in the fan rotational direction F. With this configuration, it is possible to avoid that only certain frequencies of sound are emphasized when the blower fan 10 is rotated, and thereby it is possible to limit the noise.

OTHER EMBODIMENTS

The above embodiments may be modified as follows.

Figure 12:
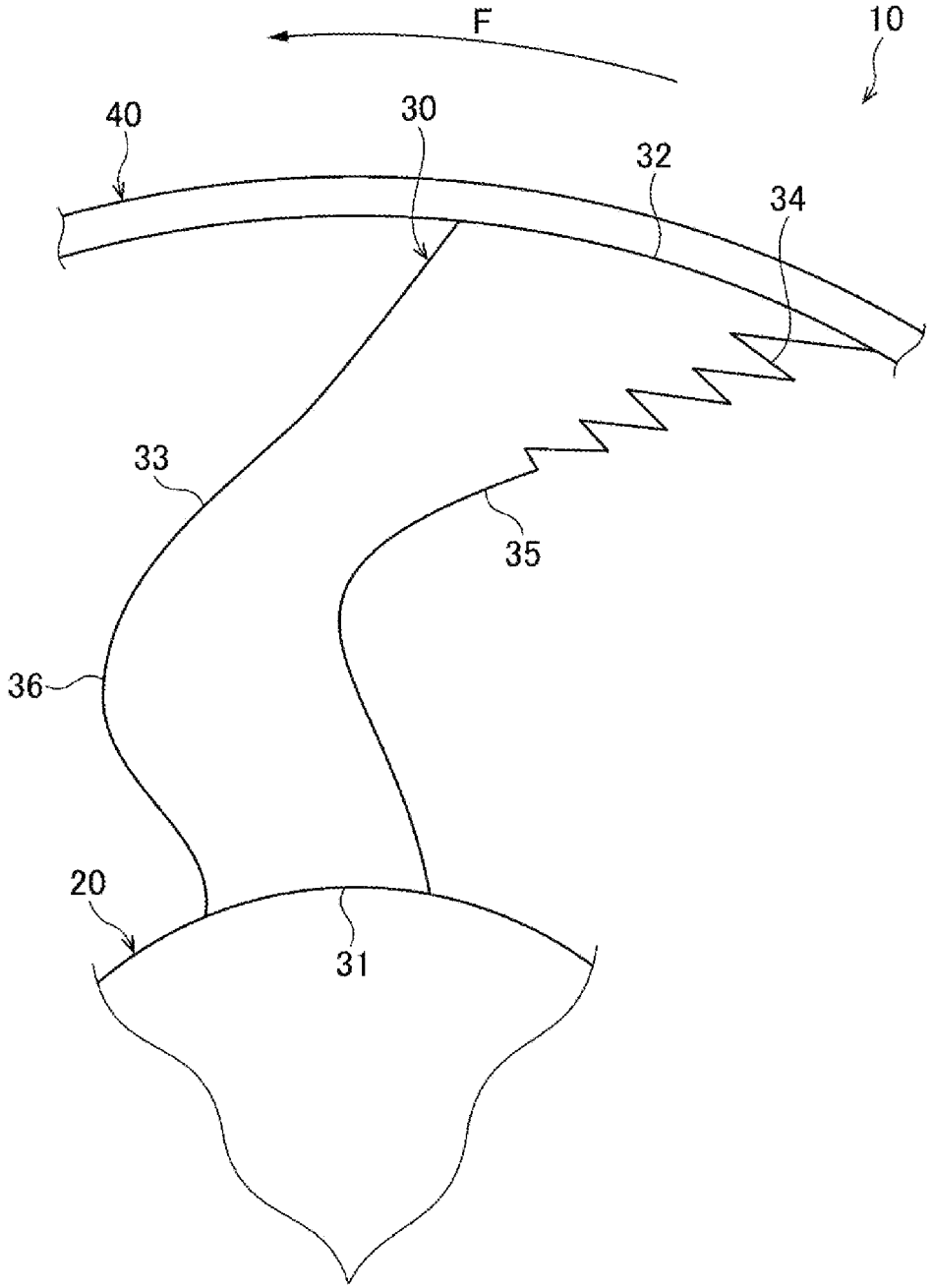
FIG. 12 is an enlarged view showing a structure of a blade according to another embodiment.
Figure 13:
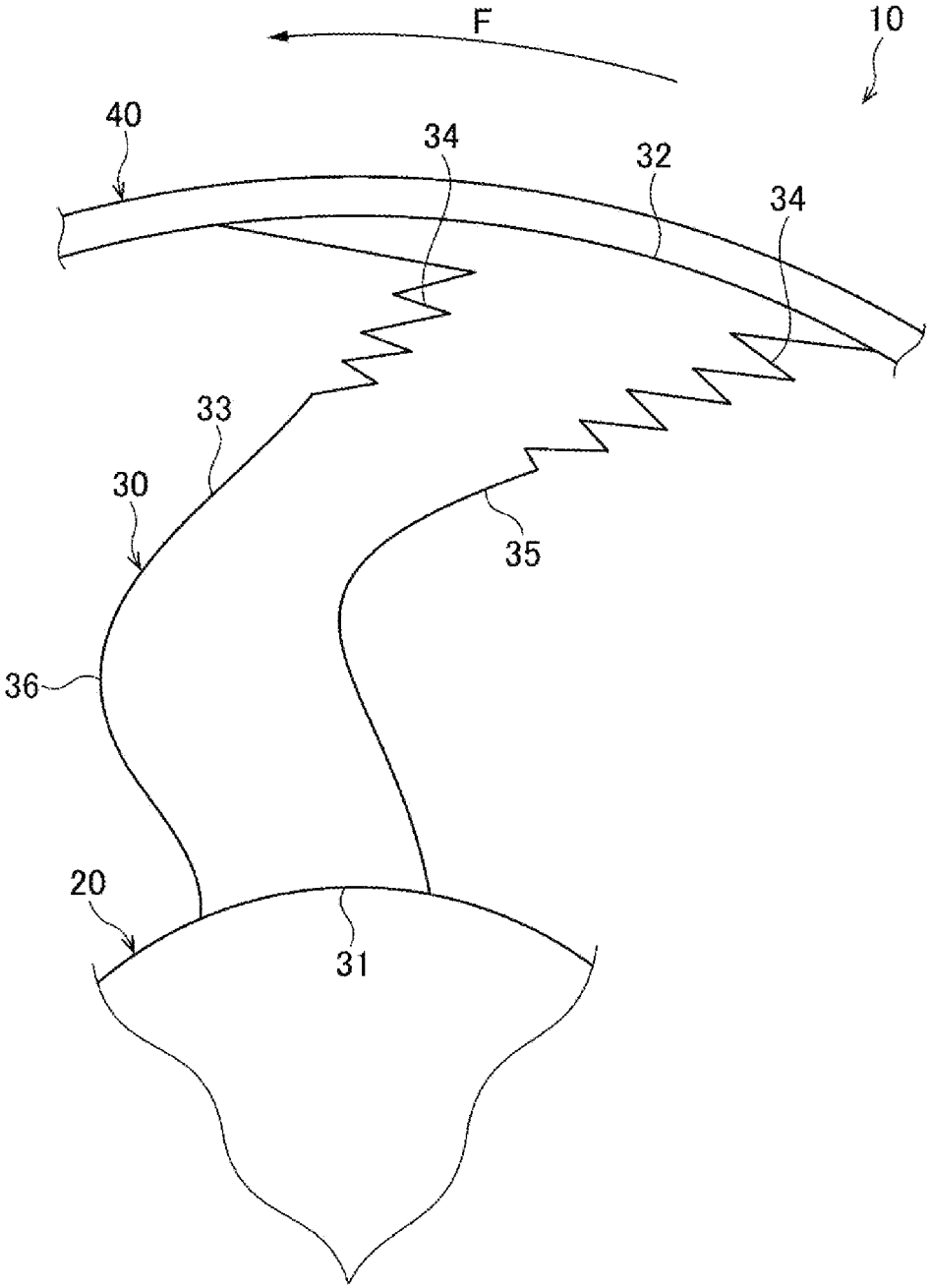
FIG. 13 is an enlarged view showing a structure of a blade according to another embodiment.

The location of the serrations 34 at each of the blades 30 can be freely changed. For example, as shown in FIG. 12, the serrations 34 may be formed at the trailing edge 35 of the distal end portion 32 of the blade 30. Alternatively, as shown in FIG. 13, the serrations 34 may be formed at both of the leading edge 33 and the trailing edge 35 of the distal end portion 32 of the blade 30.

Figure 14:
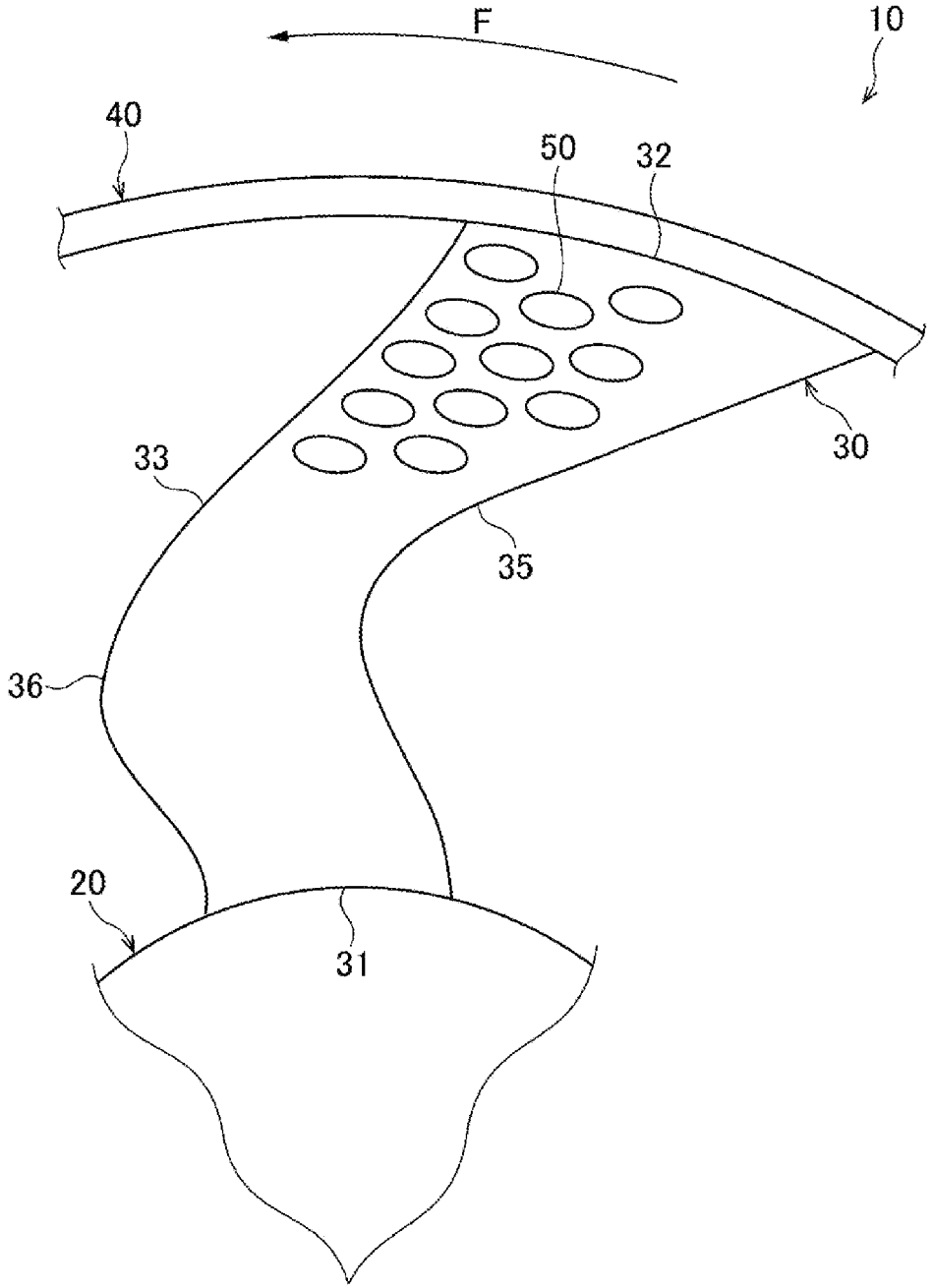
FIG. 14 is an enlarged view showing a structure of a blade according to another embodiment.
Figure 15:
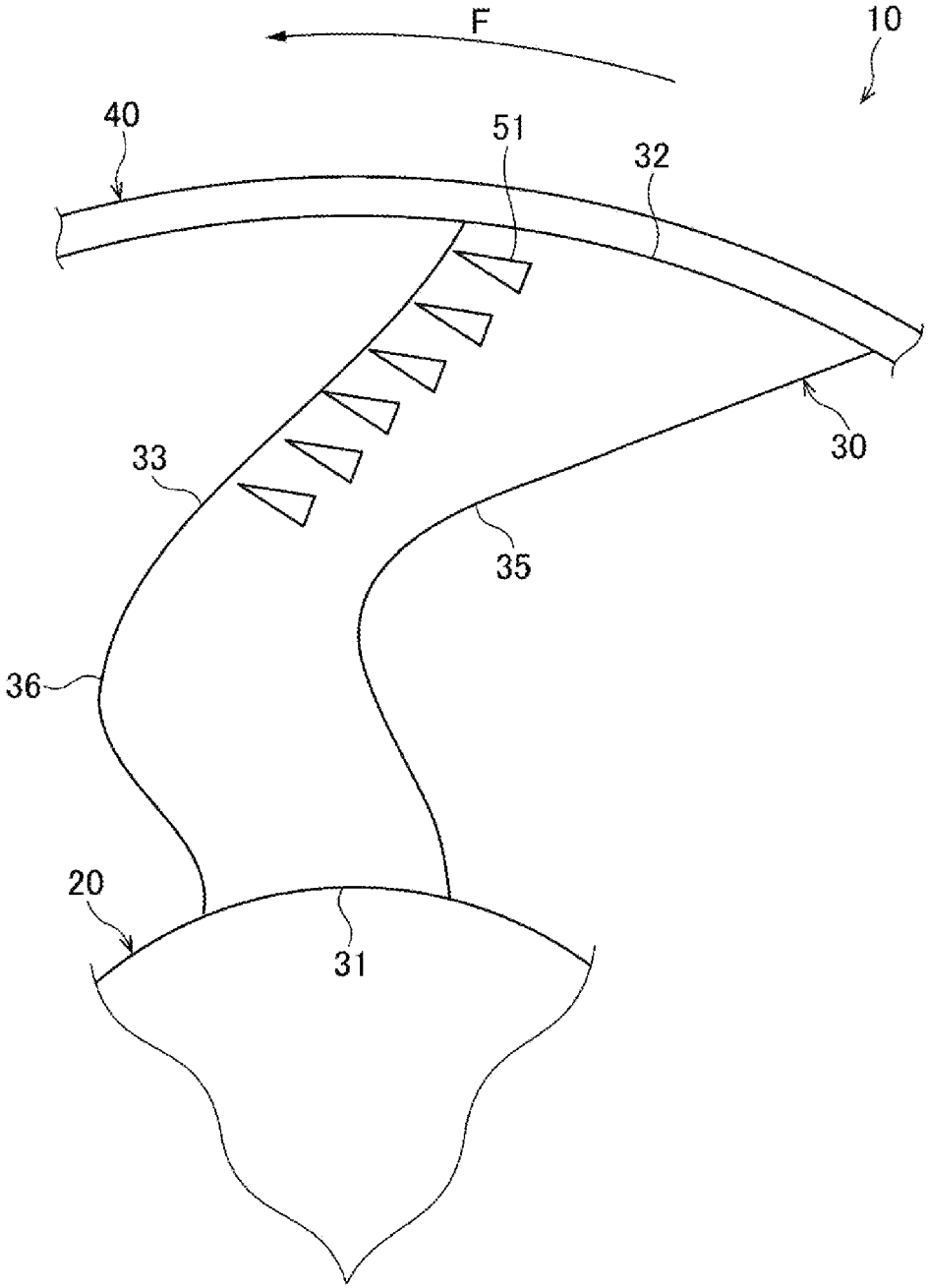
FIG. 15 is an enlarged view showing a structure of a blade according to another embodiment.

The separation limiting structure, which limits the separation of the flow of the air from the blade 30, is not limited to the serrations 34 and may be formed by recesses 50 shown in FIG. 14, or projections 51, which are shown in FIG. 15 and are collectively referred to as a vortex generator.

The present disclosure is not limited to the above specific examples. Appropriate design changes made by those skilled in the art to the above specific examples are also included in the scope of the present disclosure as long as they have the features of the present disclosure. Each element included in each specific example described above, and its arrangement, conditions, shape, etc., are not limited to those illustrated and can be changed as appropriate. As long as there is no technical contradiction, the combination of the elements included in the specific examples described above can be changed as appropriate.

What is claimed is:

1. A blower fan configured to be rotated about a fan rotational axis, which is predetermined, in a fan rotational direction, the blower fan comprising:

a hub that is placed on the fan rotational axis;

a plurality of blades that are arranged along and extend outwardly from an outer periphery of the hub; and a ring that is shaped in a circular ring form and couples a distal end portion of each of the plurality of blades, wherein:

the distal end portion of each of the plurality of blades has a separation limiting structure that is configured to limit separation of a flow of air from the blade;

each blade among the plurality of blades has a shape that directs a flow direction of the air passing through each blade to the separation limiting structure of an adjacent blade which is an adjacent one of the plurality of blades located on a rear side of each blade in the fan rotational direction;

at each blade among the plurality of blades, a base end portion is defined as an end portion of each blade that is joined to the outer periphery of the hub;

at each blade among the plurality of blades, a reference line is defined as a straight line that intersects the fan rotational axis at a right angle and passes through a center point of the base end portion of each blade centered in the fan rotational direction;

at each blade among the plurality of blades, a centerline is defined as a line that extends from the base end portion to the distal end portion along a center point of a width of each blade centered in the fan rotational direction;

at each blade among the plurality of blades, a predetermined location line is defined as a straight line that intersects the fan rotational axis at the right angle and passes through a corresponding predetermined location along the centerline of each blade;

at each blade among the plurality of blades, an angle of the predetermined location line relative to the reference line is defined as a skew angle at the corresponding predetermined location of each blade;

in a case where the predetermined location line is displaced from the reference line in the fan rotational direction, the skew angle of the predetermined location line is expressed by a positive value, and in another case where the predetermined location line is displaced from the reference line in an opposite direction, which is opposite to the fan rotational direction, the skew angle of the predetermined location line is expressed by a negative value;

each blade among the plurality of blades has a bent portion at a location that is on a base side, at which the base end portion is placed, of a center that is centered between the base end portion and the distal end portion;

at each blade among the plurality of blades, as the shape, which directs the flow direction of the air passing through each blade to the separation limiting structure of the adjacent blade, each blade has a shape, with which the skew angle is progressively increased from the base end portion to the bent portion and reaches a maximum value at the bent portion, and the skew angle is progressively reduced from the bent portion to the distal end portion and becomes the negative value at the distal end portion; and at each blade among the plurality of blades, an inner portion is defined as a portion of each blade that extends from the base end portion to the bent portion, and with respect to an imaginary straight connecting line, which connects between one end of a leading edge of the inner portion located at the base end portion and another end of the leading edge of the inner portion located at the bent portion, a portion of the leading edge of the inner portion, which is adjacent to the one end of the leading edge of the inner portion, is concave, and another portion of the leading edge of the inner portion, which is adjacent to the another end of the leading edge of the inner portion, is convex.

2. The blower fan according to claim 1, wherein:

a rear-side airflow region is defined as a region that is formed by projecting the imaginary straight connecting line in a direction that is perpendicular to the imaginary straight connecting line toward the rear side in the fan rotational direction; and at least one of the plurality of blades has a shape, with which the rear-side airflow region of the inner portion does not overlap with an entire range of a leading edge of the adjacent blade.

3. The blower fan according to claim 2, wherein the plurality of blades are arranged at different angular intervals, respectively, in the fan rotational direction.

4. The blower fan according to claim 3, wherein:

the plurality of blades include:

one or more primary blades, at each of which the rear-side airflow region of the inner portion does not overlap with the entire range of the leading edge of the adjacent blade; and one or more secondary blades, at each of which the rear-side airflow region of the inner portion overlaps with the leading edge of the adjacent blade; and a number of the one or more primary blades is larger than a number of the one or more secondary blades.

5. The blower fan according to claim 1, wherein:

at each blade among the plurality of blades, an amount of change in the skew angle in a range from the bent portion to the distal end portion is set to be in a range of 25° to 40°;

at each blade among the plurality of blades, a blade pitch is defined as a parameter that is obtained by normalizing a location along the centerline of the blade with a value in a range of 0 to 1, where 0 corresponds to a location of the base end portion, and 1 corresponds to a location of the distal end portion;

at each blade among the plurality of blades, the bent portion is located in a range of each blade which corresponds to the blade pitch of 0.2 to 0.4;

at each blade among the plurality of blades, the blade pitch, which corresponds to the location of the bent portion, is defined as Pc; and at each blade among the plurality of blades, an amount of change in a slope of the skew angle in a range of each blade, which corresponds to the blade pitch of Pc−0.1 to Pc+0.1, is set to be in a range of 60° to 90°.

6. The blower fan according to claim 1, wherein:

at each blade among the plurality of blades, a width of a cross-section of each blade, which is perpendicular to the centerline of each blade, is defined as a chord length of each blade; and at each blade among the plurality of blades, the chord length of the bent portion is longer than the chord length of the base end portion, and the chord length of the distal end portion is longer than the chord length of the bent portion.

7. The blower fan according to claim 1, wherein the number of the plurality of blades is seven.

8. The blower fan according to claim 1, wherein the plurality of blades respectively have an identical shape.

9. The blower fan according to claim 1, wherein the separation limiting structure of each blade among the plurality of blades includes a plurality of serrations that are formed as a plurality of projections respectively shaped in a triangular form.

10. A blower fan configured to be rotated about a fan rotational axis, which is predetermined, in a fan rotational direction, the blower fan comprising:

a hub that is placed on the fan rotational axis;

a plurality of blades that are arranged along and extend outwardly from an outer periphery of the hub; and a ring that is shaped in a circular ring form and couples a distal end portion of each of the plurality of blades, wherein:

the distal end portion of each of the plurality of blades has a separation limiting structure that is configured to limit separation of a flow of air from the blade;

each blade among the plurality of blades has a shape that directs a flow direction of the air passing through each blade to the separation limiting structure of an adjacent blade which is an adjacent one of the plurality of blades located on a rear side of each blade in the fan rotational direction;

at each blade among the plurality of blades, a base end portion is defined as an end portion of each blade that is joined to the outer periphery of the hub;

at each blade among the plurality of blades, a reference line is defined as a straight line that intersects the fan rotational axis at a right angle and passes through a center point of the base end portion of each blade centered in the fan rotational direction;

at each blade among the plurality of blades, a centerline is defined as a line that extends from the base end portion to the distal end portion along a center point of a width of each blade centered in the fan rotational direction;

at each blade among the plurality of blades, a predetermined location line is defined as a straight line that intersects the fan rotational axis at the right angle and passes through a corresponding predetermined location along the centerline of each blade;

at each blade among the plurality of blades, an angle of the predetermined location line relative to the reference line is defined as a skew angle at the corresponding predetermined location of each blade;

in a case where the predetermined location line is displaced from the reference line in the fan rotational direction, the skew angle of the predetermined location line is expressed by a positive value, and in another case where the predetermined location line is displaced from the reference line in an opposite direction, which is opposite to the fan rotational direction, the skew angle of the predetermined location line is expressed by a negative value;

each blade among the plurality of blades has a bent portion at a location that is on a base side, at which the base end portion is placed, of a center that is centered between the base end portion and the distal end portion;

at each blade among the plurality of blades, as the shape, which directs the flow direction of the air passing through each blade to the separation limiting structure of the adjacent blade, each blade has a shape, with which the skew angle is progressively increased from the base end portion to the bent portion and reaches a maximum value at the bent portion, and the skew angle is progressively reduced from the bent portion to the distal end portion and becomes the negative value at the distal end portion;

at each blade among the plurality of blades, an inner portion is defined as a portion of each blade that extends from the base end portion to the bent portion, and a rear-side airflow region is defined as a region that is formed by projecting a straight connecting line, which connects between one end of a leading edge of the inner portion located at the base end portion and another end of the leading edge of the inner portion located at the bent portion, in a direction that is perpendicular to the straight connecting line toward the rear side in the fan rotational direction;

at least one of the plurality of blades has a shape, with which the rear-side airflow region of the inner portion does not overlap with an entire range of a leading edge of the adjacent blade;

the plurality of blades are arranged at different angular intervals, respectively, in the fan rotational direction;

the plurality of blades include:

one or more primary blades, at each of which the rear-side airflow region of the inner portion does not overlap with the entire range of the leading edge of the adjacent blade; and one or more secondary blades, at each of which the rear-side airflow region of the inner portion overlaps with the leading edge of the adjacent blade; and a number of the one or more primary blades is larger than a number of the one or more secondary blades.

11. A blower fan configured to be rotated about a fan rotational axis, which is predetermined, in a fan rotational direction, the blower fan comprising:

a hub that is placed on the fan rotational axis;

a plurality of blades that are arranged along and extend outwardly from an outer periphery of the hub; and a ring that is shaped in a circular ring form and couples a distal end portion of each of the plurality of blades, wherein:

the distal end portion of each of the plurality of blades has a separation limiting structure that is configured to limit separation of a flow of air from the blade;

each blade among the plurality of blades has a shape that directs a flow direction of the air passing through each blade to the separation limiting structure of an adjacent blade which is an adjacent one of the plurality of blades located on a rear side of each blade in the fan rotational direction;

at each blade among the plurality of blades, a base end portion is defined as an end portion of each blade that is joined to the outer periphery of the hub;

at each blade among the plurality of blades, a reference line is defined as a straight line that intersects the fan rotational axis at a right angle and passes through a center point of the base end portion of each blade centered in the fan rotational direction;

at each blade among the plurality of blades, a centerline is defined as a line that extends from the base end portion to the distal end portion along a center point of a width of each blade centered in the fan rotational direction;

at each blade among the plurality of blades, a predetermined location line is defined as a straight line that intersects the fan rotational axis at the right angle and passes through a corresponding predetermined location along the centerline of each blade;

at each blade among the plurality of blades, an angle of the predetermined location line relative to the reference line is defined as a skew angle at the corresponding predetermined location of each blade;

in a case where the predetermined location line is displaced from the reference line in the fan rotational direction, the skew angle of the predetermined location line is expressed by a positive value, and in another case where the predetermined location line is displaced from the reference line in an opposite direction, which is opposite to the fan rotational direction, the skew angle of the predetermined location line is expressed by a negative value;

each blade among the plurality of blades has a bent portion at a location that is on a base side, at which the base end portion is placed, of a center that is centered between the base end portion and the distal end portion;

at each blade among the plurality of blades, as the shape, which directs the flow direction of the air passing through each blade to the separation limiting structure of the adjacent blade, each blade has a shape, with which the skew angle is progressively increased from the base end portion to the bent portion and reaches a maximum value at the bent portion, and the skew angle is progressively reduced from the bent portion to the distal end portion and becomes the negative value at the distal end portion;

at each blade among the plurality of blades, an amount of change in the skew angle in a range from the bent portion to the distal end portion is set to be in a range of 25° to 40°;

at each blade among the plurality of blades, a blade pitch is defined as a parameter that is obtained by normalizing a location along the centerline of the blade with a value in a range of 0 to 1, where 0 corresponds to a location of the base end portion, and 1 corresponds to a location of the distal end portion;

at each blade among the plurality of blades, the bent portion is located in a range of each blade which corresponds to the blade pitch of 0.2 to 0.4;

at each blade among the plurality of blades, the blade pitch, which corresponds to the location of the bent portion, is defined as Pc; and at each blade among the plurality of blades, an amount of change in a slope of the skew angle in a range of each blade, which corresponds to the blade pitch of Pc−0.1 to Pc+0.1, is set to be in a range of 60° to 90°.

* * * * *